United States Patent [19]

Daniels

[11] 3,993,296

[45] Nov. 23, 1976

[54] WORKPIECE-HANDLING APPARATUS

[75] Inventor: Dennis Daniels, Bellevue, Wash.

[73] Assignee: U.S. Amada, Ltd., City of Industry, Calif.

[22] Filed: June 30, 1975

[21] Appl. No.: 591,534

[52] U.S. Cl. ..... 269/24; 269/303

[51] Int. Cl.[2] ..... B25B 1/18

[58] Field of Search ..... 269/134, 221, 157, 237, 269/238, 303, 315, 24

[56] References Cited

UNITED STATES PATENTS

| | | | |
|---|---|---|---|
| 851,931 | 4/1907 | Grossman | 269/303 |
| 2,684,715 | 7/1954 | Myers | 269/303 |
| 2,908,205 | 10/1959 | Furman et al. | 269/134 |
| 3,281,140 | 10/1966 | Smierciak | 269/24 |
| 3,520,219 | 7/1970 | Treff | 269/303 |
| 3,700,227 | 10/1972 | Sessody | 269/24 |

*Primary Examiner*—Al Lawrence Smith
*Assistant Examiner*—Robert C. Watson
*Attorney, Agent, or Firm*—Seed, Berry, Vernon & Baynham

[57] ABSTRACT

A workpiece clamp is provided with a stationary first workpiece-engaging member and a movable second workpiece-engaging member which is slidable along its longitudinal axis from an extended position where it is closely spaced and aligned above the first workpiece-engaging member to a retracted position where it is moved upwardly away from the first workpiece-engaging member and slid longitudinally rearwardly of the first workpiece-engaging member for lifting or placing a workpiece in position for clamping.

1 Claim, 4 Drawing Figures

FIG. 3
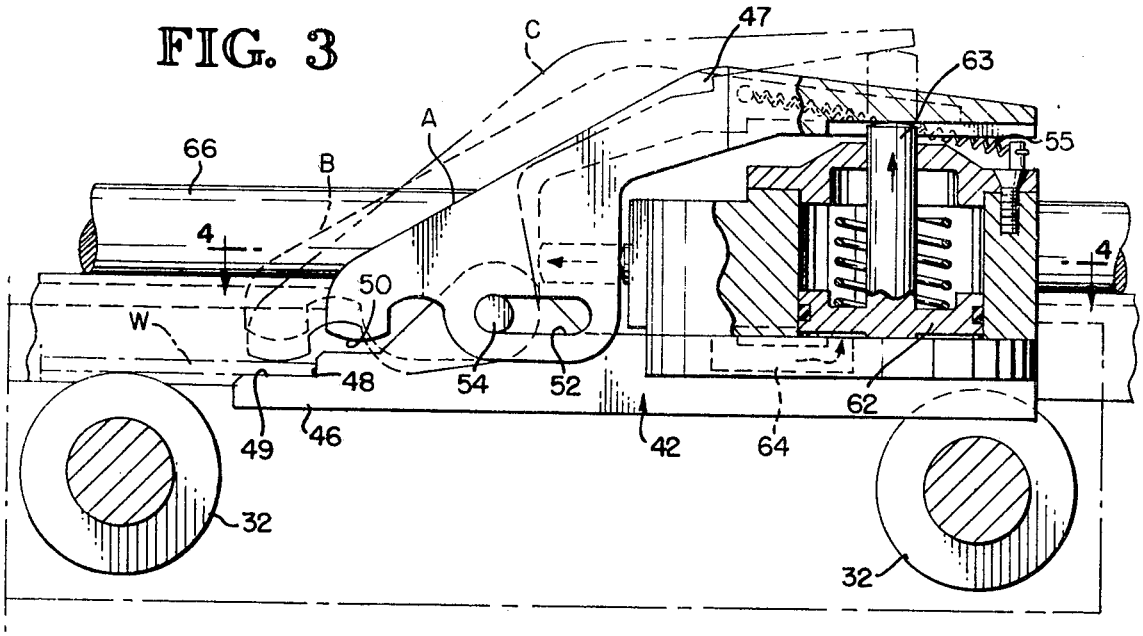
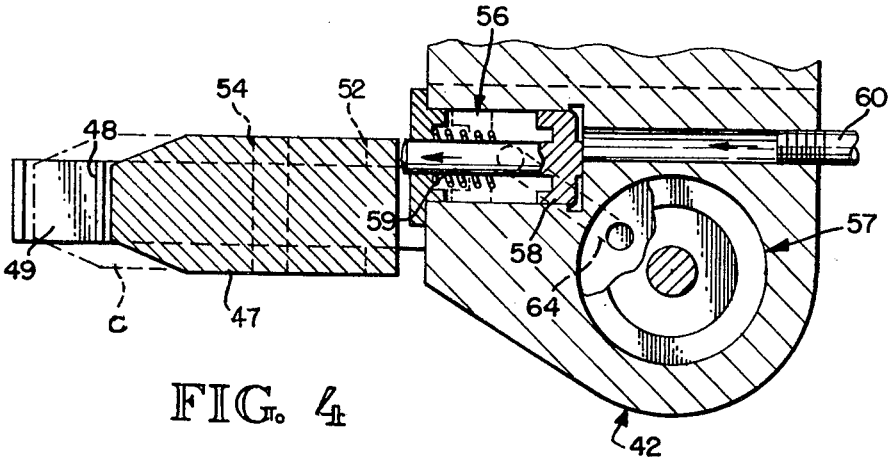
FIG. 4

WORKPIECE-HANDLING APPARATUS

BACKGROUND OF THE INVENTION

1. Field of the Invention

The invention pertains to a workpiece clamp that is particularly useful for allowing removal of the workpieces from above the clamp.

2. Description of the Prior Art

Workpiece clamps have heretofore been provided with an upper part which is rotatable in a horizontal plane to allow the placement of a workpiece on the lower part of the clamp. Such work clamps have not operated effectively in some cases due to the difficulty in having to provide both a rotational force and a clamping force on the upper clamp member.

SUMMARY OF THE INVENTION

It is an object of this invention to provide workpiece holding means that is simple to manufacture and operates efficiently to open and close on a workpiece.

It is another object to provide a workpiece clamp which is pneumatically operated to uncover one of the members of the clamp so that the workpiece can be moved into engagement with the exposed member of the clamp in a direction perpendicular to the face of the exposed member.

It is another object of this invention to provide a workpiece clamp in which the upper member or finger of the clamp can be raised and slid longitudinally of the clamp member to expose the face of the lower clamp member.

Basically, these objects are obtained by providing a workpiece clamp with a housing having a first workpiece-engaging member stationary with the housing and a second workpiece-engaging member which is movable relative to the stationary workpiece-engaging member from an extended position in which the movable workpiece-engaging member is overlying the stationary workpiece-engaging member and biased toward the stationary workpiece-engaging member and then is movable along the length of the stationary workpiece-engaging member into a retracted position spaced from the stationary workpiece-engaging member and movable in a direction along the length of the first workpiece-engaging member.

In the preferred form of this invention, the movable workpiece-engaging member is first slid outwardly into opposed position relative to the stationary workpiece-engaging member and then is subsequently pivoted toward the stationary workpiece-engaging member. Movement outwardly is effected by a pneumatically powered piston which, after it has moved to extend the movable workpiece-engaging member, automatically directs the pneumatic pressure to a second pneumatic piston to pivot the movable workpiece-engaging member toward the stationary workpiece-engaging member.

As is readily apparent, the control can be obtained pneumatically and with simple movements to effect engagement and disengagement of the workpiece.

BRIEF DESCRIPTION OF THE FIGURES OF THE DRAWING

FIG. 3 is a fragmentary section taken through a workpiece clamp embodying the principles of the invention.

FIG. 4 is a section taken along the line 4—4 of FIG. 3.

DESCRIPTION OF THE PREFERRED EMBODIMENTS

Figure 1:
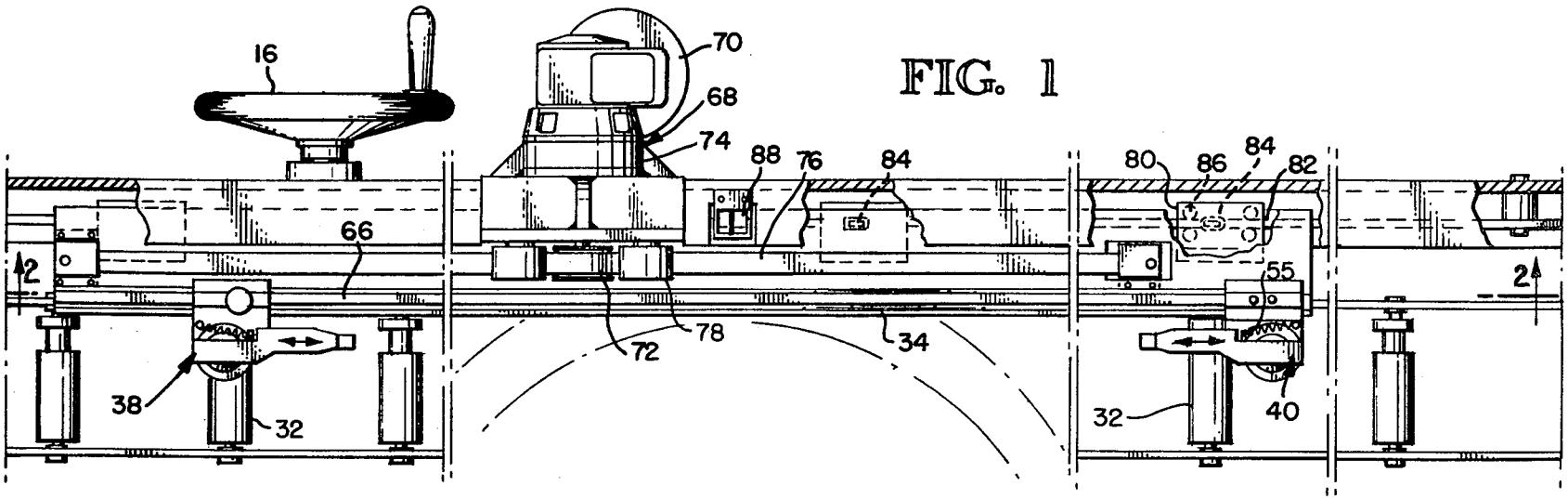
FIG. 1 is a fragmentary plan of a portion of the apparatus using a workpiece clamp.
Figure 2:
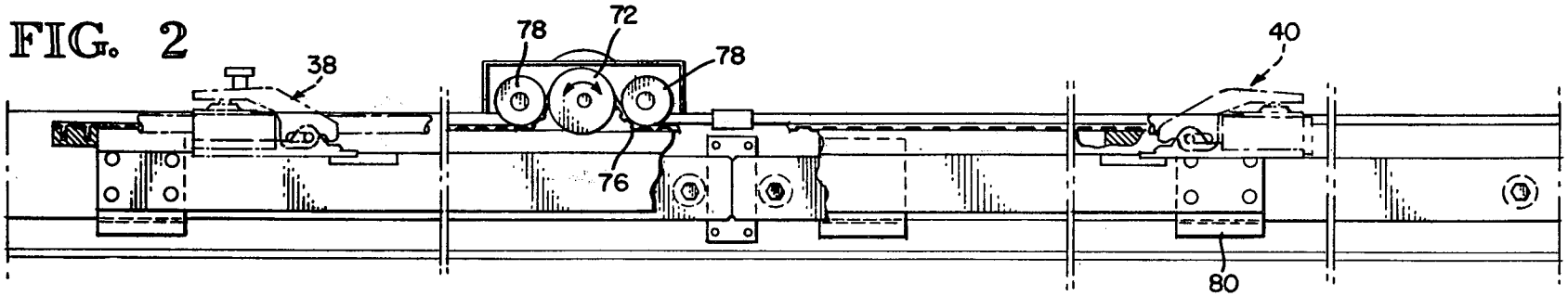
FIG. 2 is a fragmentary vertical section taken along the line 3—3 of FIG. 1.

FIG. 1 illustrates an ironworker, typical of a type of apparatus requiring movement and handling of elongated workpieces, such as elongated structural members W or the like. The ironworker is provided with tools mounted on a turret 11 which can be rotated to position the tools at an operating station, such as a punching station. A workpiece-supporting table holds the workpiece and allows it to be moved relative to the tool at the operating station so that the desired punching, shearing, notching, drilling or suitable operation can be performed at an exact location on the workpiece.

The table is also provided with a plurality of rollers 32 for moving the workpiece lengthwise on the table and a vertical gauge bar 34. As is well understood, the workpiece is slid on the rollers and abuts against the gauge bar 34. Movement of the crank 16 then moves the table with the workpiece toward and away from the operating station to accurately position the workpiece laterally.

Movement of the workpiece lengthwise can be accomplished mechanically through a manual input or automatically through a conventional numerical control input. For this purpose, the table is provided with a pair of workpiece clamps 38 and 40, embodying the principles of this invention, which lie in opposed relation at a substantial distance from each other on the table. The clamps 38 and 40 are identical and, as best shown in FIG. 3, include a housing 42 which is integrally provided with a stationary workpiece-engaging member or finger 46 and a movable workpiece-engaging member or finger 47. Finger 46 is provided with a recess having a stop or gauging surface 48 and a clamping surface 49. Finger 47 is provided with a clamping surface 50.

Movable finger 47 can be slid longitudinally of its length from a solid line position marked A through an intermediate position marked B where it extends out over the surface 49 and thence into a clamping position marked C where it can squeeze the workpiece between the surface 50 and the surface 49 to hold it tightly during movement of the clamp.

In order to move the movable finger 47, the movable finger is provided with a slot 52 that rides on a pin 54 mounted on the housing 42. The movable finger 42 is held in a retracted position by a spring 55 and thus allows a workpiece to be lowered vertically onto the surface 49 of the stationary finger 46. The movable finger is extended against the force of the spring 47 by a pair of interrelated pneumatic cylinder and piston actuators 56 and 57. Actuator 56 is provided with a piston 58 having a piston rod 59 that abuts against the movable finger 47. Air pressure from a line 60 moves the piston 58 to the left to extend the movable finger to the left, as viewed in FIG. 3. Actuator 57 is provided with a piston 62 having a piston rod 63 that abuts against the underside of the rearward end of the finger 47. Piston 62 is raised by air pressure from a conduit 64, as best shown in FIG. 4, that is opened after the piston 58 is moved past the conduit. Thus, air entering conduit 60 first moves the piston 58 to move the finger 47 along the pin 54 to position B, and thence the finger is pivoted about the pin 54 into position C.

Clamp 38 is adjustably secured to a guide member 66 that runs over a substantial length of the table. The adjustment allows the clamp to be moved to accommodate different lengths of workpieces. Clamp 40 is more permanently secured to the guide member 40 so that measurements along the workpiece can be taken from clamp 40 as a reference point.

The overall operation of the apparatus using the unique clamps of this invention is readily understood. An operator places an elongated workpiece on the rollers 32 and into the opened clamp 40. The clamp 38, if two clamps are used, is then slid along the guide bar 66 until the stop surface 48 engages the end of the workpiece. The clamps are then closed to hold the workpiece. Lateral positioning of the workpiece is obtained by cranking the handle 16 to shift the table laterally toward or away from the operating station. The clamps 38 and 40 are then moved to the desired location lengthwise beneath the operating station. The punching or other suitable operation then occurs and subsequent movements can proceed until the operation is completed on the workpiece.

While the preferred embodiments of the invention have been illustrated and described, it should be understood that variations will be apparent to one skilled in the art without departing from the principles of the invention. Accordingly, the invention is not to be limited to the specific forms illustrated.

I claim:

1. A workpiece clamp for planar sheets or structural members, such as angles, I-bars or the like, comprising a clamp housing, first workpiece-engaging means stationarily provided on said housing and having a forward end, second workpiece-engaging means movably mounted on said housing for movement from an extended position in alignment with and opposed in close adjacency to said first workpiece-engaging means forward end to a retracted position more widely spaced from and rearward of said first workpiece-engaging means forward end, and means for moving said second workpiece-engaging means between said extended and retracted positions, said means for extending said second workpiece-engaging means including first fluid powered piston means for moving the second workpiece-engaging means first longitudinally into an opposed aligned position over said first workpiece-engaging means, and second fluid powered piston means for subsequently moving the second workpiece-engaging means toward the first workpiece-engaging means to pinch the workpiece therebetween, said housing including a transverse pin, said second workpiece-engaging means including a longitudinal slot receiving said in, said first fluid powered means including a first piston extendible to move said slot along said pin to extend said second workpiece-engaging means, said second fluid powered means including a second piston extendible upwardly to pivot said second workpiece-engaging means about said transverse pin toward said first workpiece-engaging means, said means for retracting said second workpiece-engaging means including a spring.

* * * * *